US006485398B1

(12) United States Patent
Kreft

(10) Patent No.: US 6,485,398 B1
(45) Date of Patent: Nov. 26, 2002

(54) EXERCISE APPARATUS

(76) Inventor: Paul H. Kreft, 86-14 55 Rd., Elmhurst, NY (US) 11373

( * ) Notice: Subject to any disclaimer, the term of this patent is extended or adjusted under 35 U.S.C. 154(b) by 0 days.

(21) Appl. No.: 09/510,886

(22) Filed: Feb. 23, 2000

Related U.S. Application Data

(60) Provisional application No. 60/125,012, filed on Mar. 18, 1999.

(51) Int. Cl.[7] ..... A63B 21/06

(52) U.S. Cl. ..... 482/94; 482/93; 482/96; 482/147; 601/23

(58) Field of Search ..... 482/13, 23, 92, 482/93, 94, 95, 96, 100, 110, 115, 126, 130, 131, 136, 146, 147, 148, 907, 908; 601/23, 24, 29, 32

(56) References Cited

U.S. PATENT DOCUMENTS

| | | | | | |
|---|---|---|---|---|---|
| 3,604,722 | A | * | 9/1971 | Boley | 280/87.01 |
| 3,659,844 | A | * | 5/1972 | Cummins | 272/58 |
| D226,439 | S | | 3/1973 | Coker | |
| 4,193,592 | A | * | 3/1980 | Bishow | 272/114 |
| 4,349,193 | A | | 9/1982 | Lambert, Jr. et al. | 272/118 |
| 4,647,041 | A | | 3/1987 | Whiteley | 272/132 |
| 4,787,630 | A | * | 11/1988 | Watson et al. | 272/146 |
| 4,846,465 | A | * | 7/1989 | Iams et al. | 272/127 |
| 5,599,261 | A | | 2/1997 | Easley et al. | 482/130 |
| 5,599,262 | A | * | 2/1997 | Shih | 482/147 |
| 5,667,462 | A | * | 9/1997 | Gordon | 482/80 |
| 5,702,329 | A | | 12/1997 | Koenig | 482/97 |
| 5,766,119 | A | * | 6/1998 | Clark | 482/146 |
| 5,779,607 | A | | 7/1998 | Harris | 482/140 |
| 5,941,807 | A | * | 8/1999 | Cassidy et al. | 482/146 |

* cited by examiner

*Primary Examiner*—Jerome W. Donnelly
*Assistant Examiner*—Tam Nguyen
(74) *Attorney, Agent, or Firm*—Ostrolenk, Faber, Gerb & Soffen, LLP

(57) ABSTRACT

An exercise apparatus to strengthen the abdominal and oblique muscles in a relaxed state by kneeling and twisting the lower torso. An embodiment configured according to principles of the invention includes a height-adjustable, contoured knee rest rotatingly mounted on a base. Handles extend from the base to where a user may comfortably grasp the handles while kneeling on the knee rest. The user exercises with the present exercise apparatus by urging the user's lower torso to rotate the knee rest. Rotation may be resisted by increasing the inertia of the knee rest with weights suspended from weight arms connected to the knee rest.

14 Claims, 5 Drawing Sheets

EXERCISE APPARATUS

CROSS-REFERENCE TO RELATED APPLICATION

This Application incorporates by reference herein and claims priority to United States Provisional Application No. 60/125,012, filed Mar. 18, 1999, entitled "EXERCISE APPARATUS."

BACKGROUND OF THE INVENTION

1. Field of the Invention

The present invention relates to physical fitness equipment, specifically to an exercise apparatus that efficiently strengthens the upper and lower abdominal muscles (rectus abdominis) and the externus oblique muscles.

2. Discussion of Related Art

As daily living shifts from reliance on physically demanding to more sedentary activities, human bodies become susceptible to unfitness. Many engage in a regimen of various physical activities, which often include interaction with inanimate objects, such as free weights, and machines, such as stationary bicycles, to preserve or regain fitness.

The body has many muscle groups which are responsible for controlling independent body functions. For example, muscles for extending an arm are independent of muscles for raising a leg. Thus, exercising one muscle group may not exercise another.

Accordingly, to preserve or regain muscle fitness, the body must engage in activities that exercise the muscle groups desired to be fit. However, some muscle groups, the abdominal and oblique muscle groups in particular, are difficult to condition.

Many devices exist for exercising the abdominal and oblique muscle groups. Such devices typically involve simple bending. See, for example, U.S. Pat. Nos. 4,647,041; 5,559,261; 5,702,329; and 5,779,607. However, simple bending does not adequately or efficiently exercise the abdominal and oblique muscle groups.

Other devices involve seated twisting. See, for example, U.S. Pat. No. 4,349,193. Sitting contracts the abdominal muscles. Thus, exercising while in a seated position does not exercise the abdominal muscles in a relaxed state.

Unfortunately, none of the foregoing provides an exercise apparatus to strengthen abdominal and oblique muscles in a relaxed state.

SUMMARY OF THE INVENTION

The invention is an exercise apparatus to strengthen the abdominal and oblique muscles in a relaxed state by kneeling and twisting the lower torso.

The present invention provides an exercise apparatus that is easy to operate and adapt to a user's changing fitness needs and which efficiently strengthens the upper and lower abdominal muscles and the externus oblique muscles.

Other features and advantages of the present invention will become apparent from the following description of the invention which refers to the accompanying drawings.

An embodiment configured according to principles of the invention includes a height-adjustable, contoured knee rest rotatingly mounted on a base. Handles extend from the base to where a user may comfortably grasp the handles while kneeling on the knee rest. The user exercises with the present exercise apparatus by urging the user's lower torso to rotate the knee rest. Rotation may be resisted by increasing the inertia of the knee rest with weights suspended from weight arms connected to the knee rest.

BRIEF DESCRIPTION OF THE DRAWINGS

The invention is described in detail below with reference to the following figures, throughout which similar reference characters denote corresponding features consistently, wherein.

DETAILED DESCRIPTION OF THE INVENTION

Figure 1:
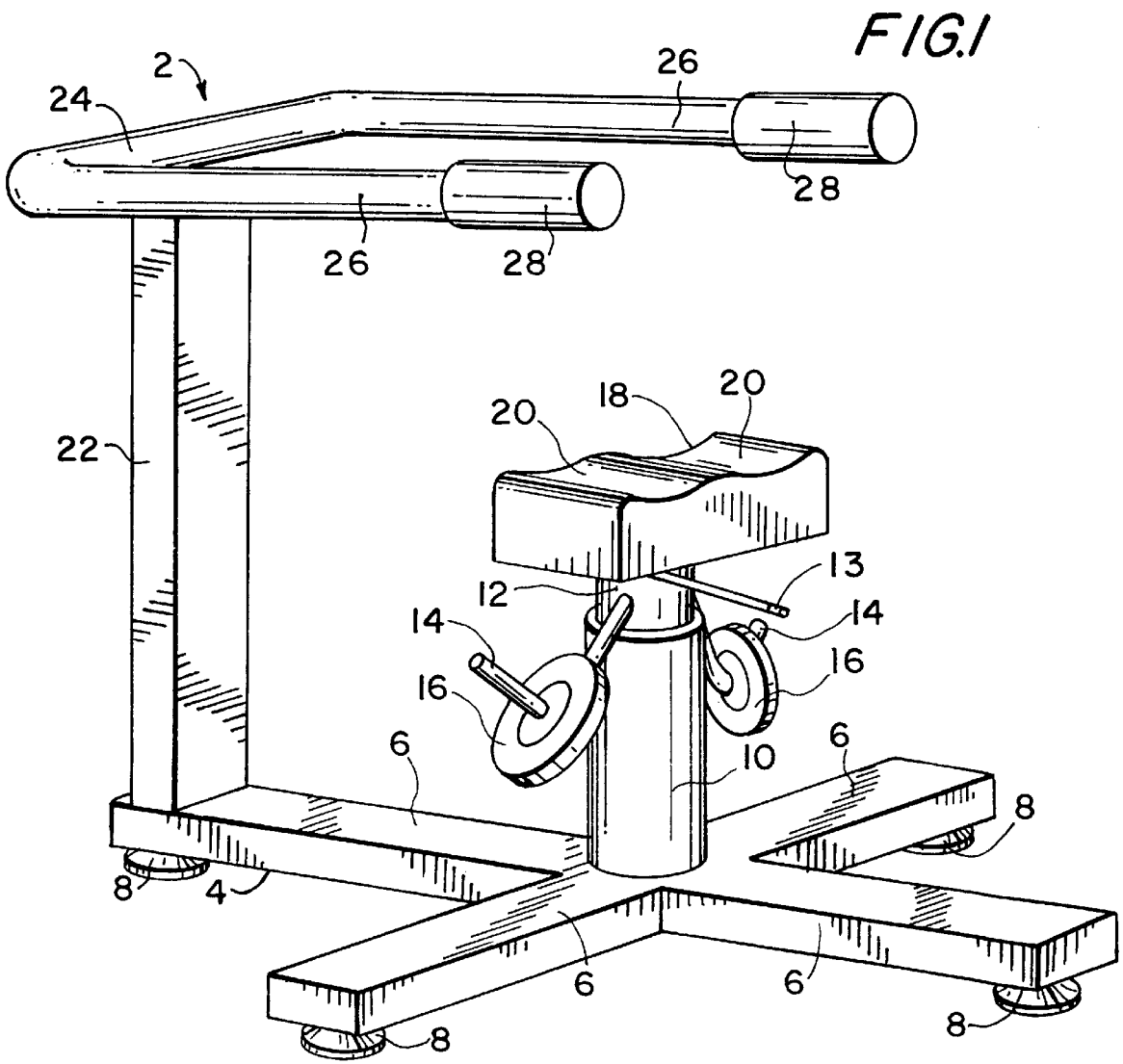
FIG. 1 is a perspective view of the present invention.

The invention is an exercise apparatus to strengthen the abdominal and oblique muscles in a relaxed state by kneeling and twisting the lower torso.

Reference is now made to the drawings in which like reference numerals refer to like elements. FIGS. 1–5 show the exercise apparatus of the present invention in which the exercise apparatus 2 is comprised of a base member 4 made of a strong material, preferably a polymer, graphite, metal or alloy. Its purpose is to maintain the balance of, and support the weight of, the apparatus and user. The base member 4 has a series of legs 6 configured in a cross or "t" shape which serve to optimize stability and minimize fabrication costs. At the end of each of the legs 6 are nonskid pads 8 preferably made of rubber. The nonskid pads 8 serve to minimize slip between the apparatus 2 and the floor.

A vertical stationary cylinder 10 is affixed to the base 4 and is positioned at the point of intersection of the legs 6. Within the stationary cylinder 10 there is a rotating cylinder .12. The rotating cylinder 12 is rotatably coupled to the stationary cylinder 10. Two weight arms 14 are mounted on directly opposing sides of the rotating cylinder 12. Both the stationary 10 and rotating cylinders 12 and the weight arms 14 are made of a strong material, preferably a polymer, graphite, metal or alloy. The stationary 10 and rotating cylinders 12 contain a height adjustment mechanism 13 similar to that found in a rotating office chair, for example, pneumatic or screw-type adjustment.

Each weight arm 14 is hook-shaped and is positioned on the rotating cylinder 12 such that free weights 16 can be inserted over the open end of the weight arm 14. Free weights 16 are added to increase the internal resistance of, hence the energy required to operate, the apparatus, thereby allowing the apparatus to be adapted to different users' exercise requirements.

A cushioned knee rest 18 is attached to the top of the rotating cylinder 12. The knee rest 18 is arranged such that it supports the user in a kneeling position, i.e., the user position. Deep contours 20 in the knee rest 18 minimize slipping between the apparatus and the user by supporting the lateral force applied to the knee rest 18 as a result of the rotating motion. Preferably, the knee rest is arranged such that it is long enough to comfortably support the user's legs from the knee area to an area just above the ankle.

A vertical support 22 is preferably made of a polymer, graphite, metal or alloy and is positioned at an end of one of the legs 6. An arm member 24 forming a "U" shape defining two arms 26 is attached to the top of the vertical support 22 such that the arm member 24 extends perpendicularly from the vertical support 22 in a horizontal plane towards the knee rest 18. Grips 28 surround the ends of each arm 26, thereby providing a cushion for a user's hands. The grips 28 can preferably be, for example, foam rubber or a suitable synthetic material used in the grip field.

Figure 6:
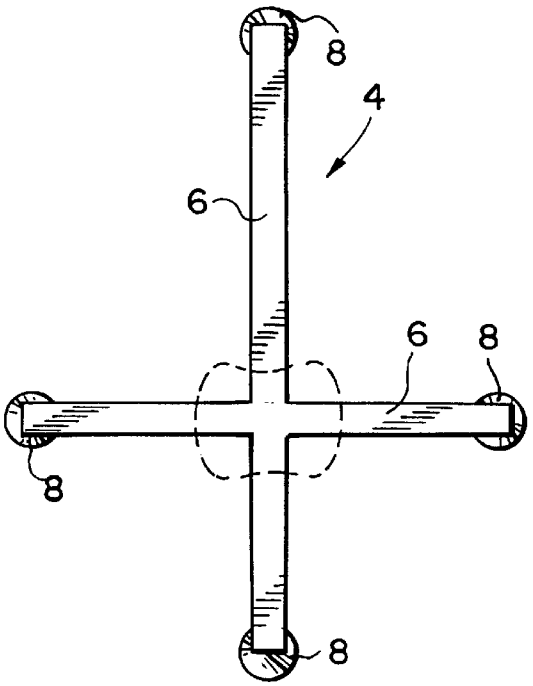
FIG. 6 is a top view showing an alternate configuration for the base of the present invention.
Figure 4:
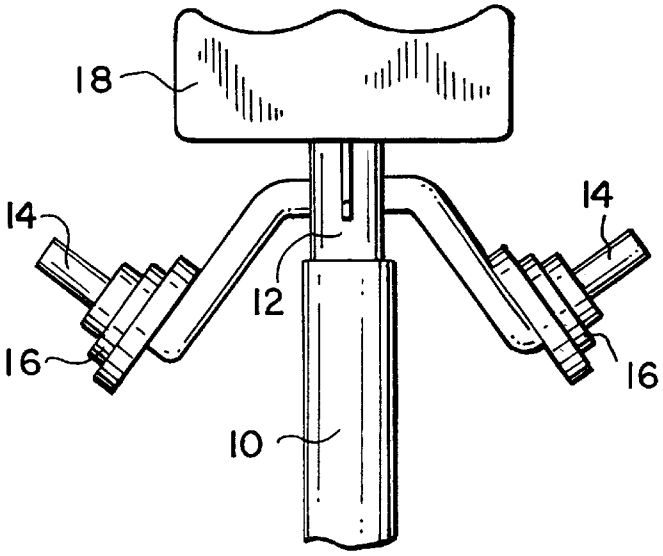
FIG. 4 is a rear side view showing the kneeling system, support, and free weight resistance system of the present invention.
Figure 5:
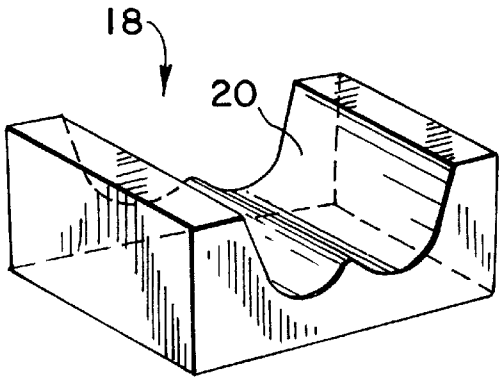
FIG. 5 is a perspective view of the knee rest of the present invention.
Figure 2:
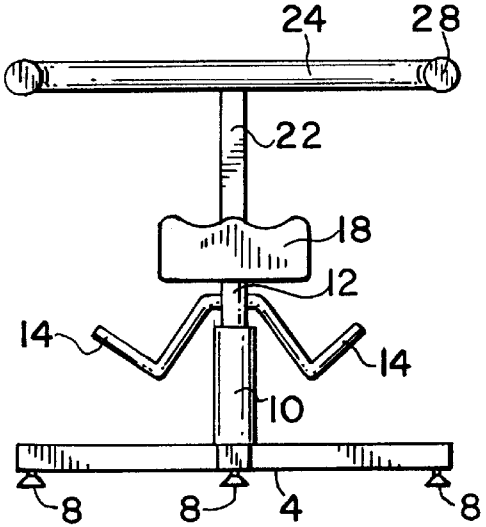
FIG. 2 is a rear side view of the present invention.
Figure 3:
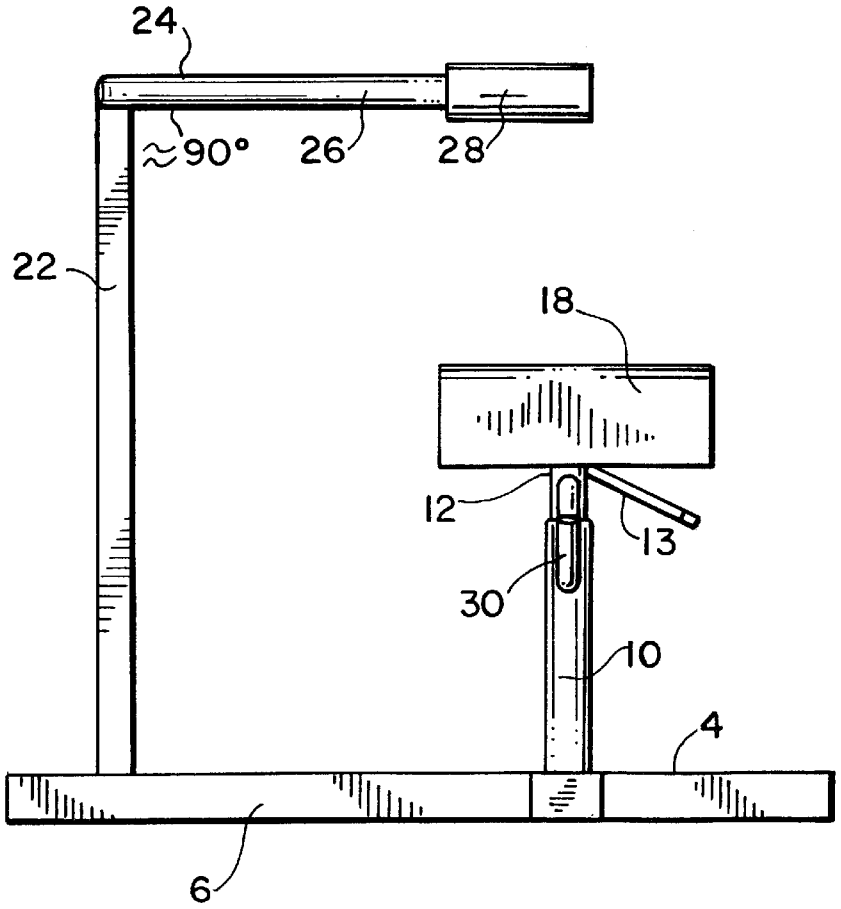
FIG. 3 is a side view of the present invention.

FIG. 6 is a top view showing a different base configuration in which the nonskid pads 8 are positioned such that they extend slightly past the ends of the legs 6 and are slightly wider than the legs 6.

Figure 7:
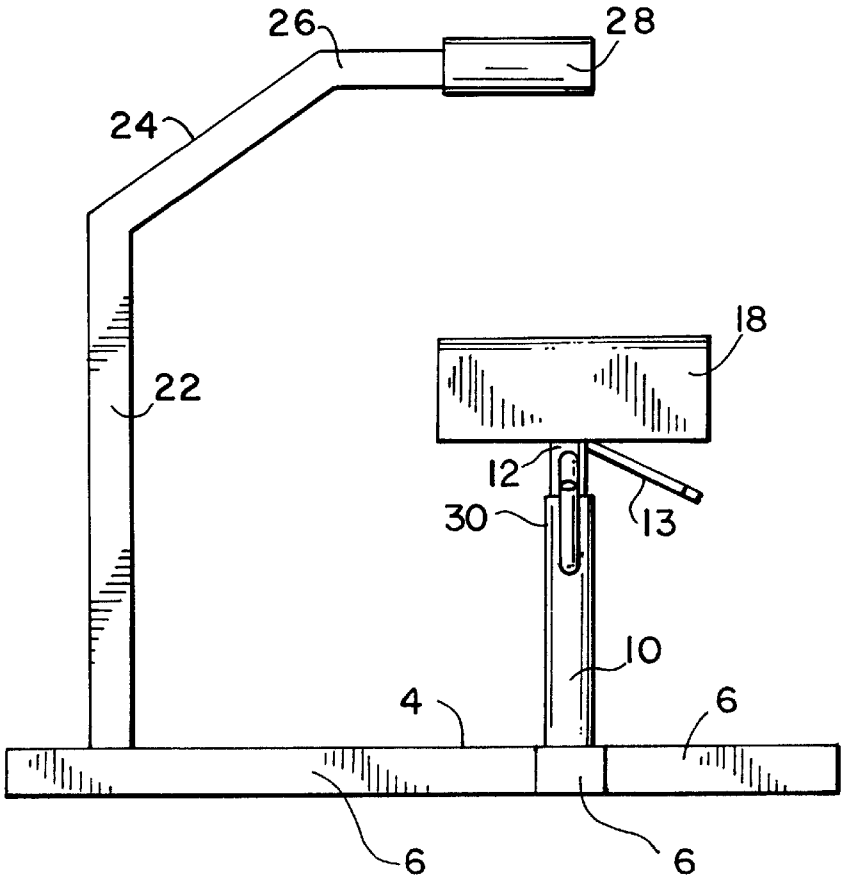
FIG. 7 is a side view showing an alternative arrangement for the arm member of the present invention.

FIG. 7 is a side view showing an alternate arrangement of the arm member 24 and an internal resistance system 30. As shown in FIG. 7, this alternate arm member extends up and towards the user position, thereby allowing a, shorter vertical support 22. The internal resistance system 30 is built within the confines of the stationary cylinder 10 and the rotating cylinder 12.

Figure 8:
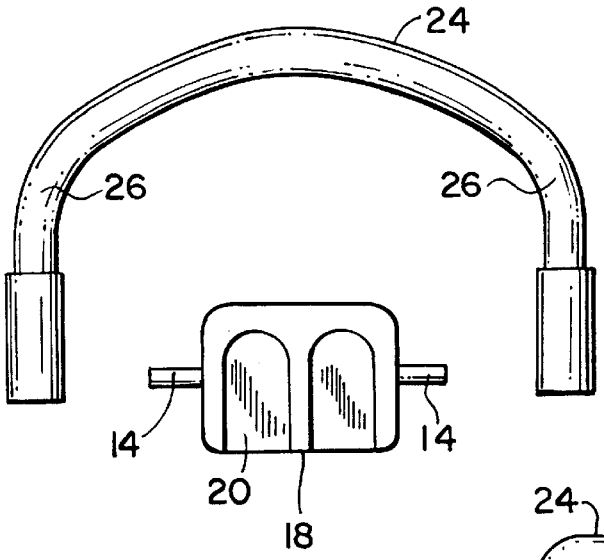
FIGS. 8–11 are top views showing additional alternative arrangements for the arm member and an alternative base of the present invention.

FIG. 8 shows still another alternative for the arm member 24 in which the portions of the arm member 24 which extend from the vertical column 22 are rounded.

Figure 9:
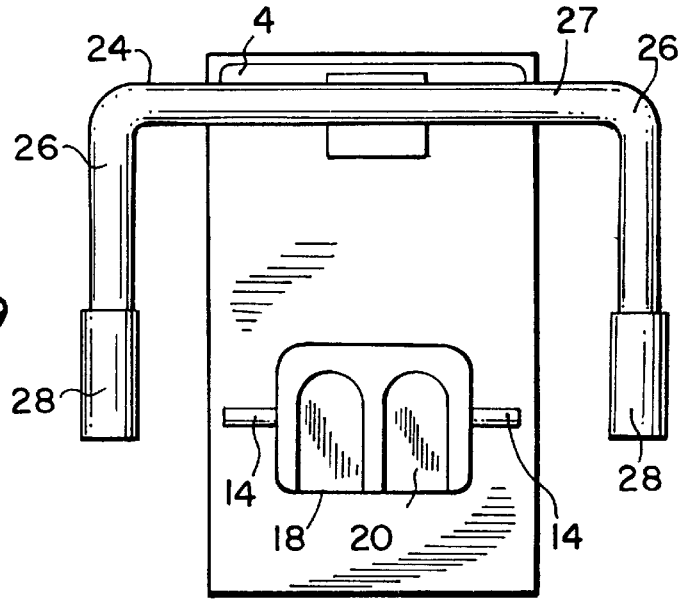

FIG. 9 shows yet another alternative for the arm member 24, in which the arms 26 are positioned perpendicularly to an arm support 28, the arm support 28 being mounted to the vertical support 22. In addition, FIG. 9 shows an alternative configuration for the base 4 in which the base 4 is a planar support upon which the stationary column 10, the vertical support 22 and the nonskid pads 8 are mounted.

Figure 10:
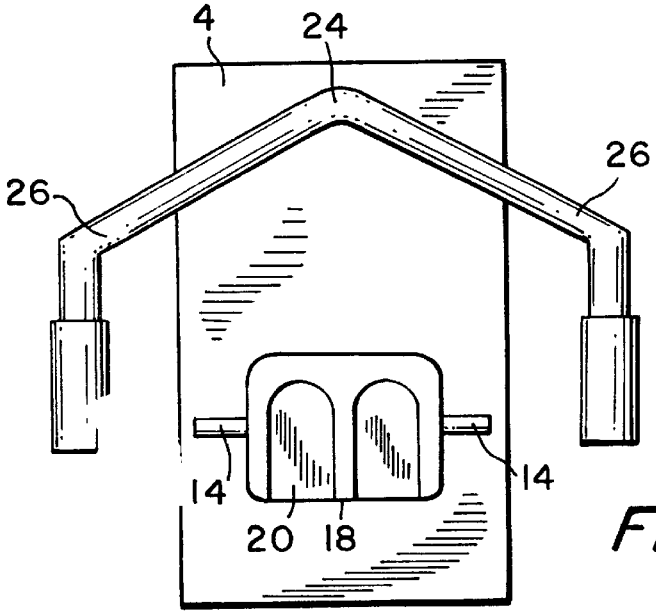

FIG. 10 shows another alternative arrangement for the arm member 24 in which the arms 26 extend away from the vertical support 22 forming a "V" shape in which the ends of the arms 26 are positioned such that they are tangential to the user position and are easily grabbed by the user's hands.

Figure 11:
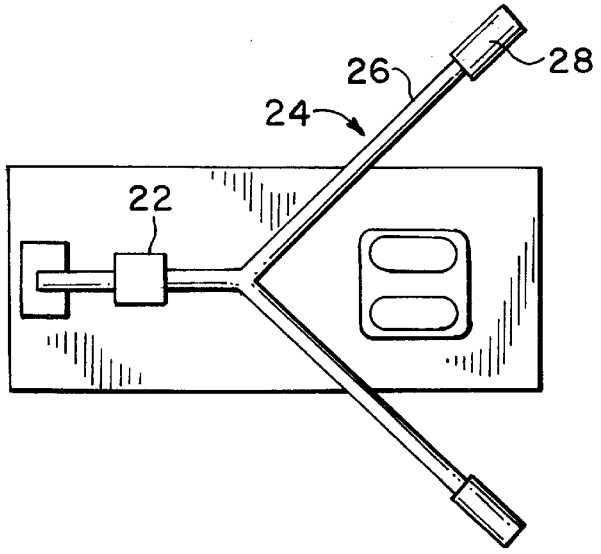

FIG. 11 shows a further alternative arrangement for the arm member 24 in which the arms 26 extend away from the vertical support 22 forming a continuous "V" shape. The ends of the arms 26 are positioned such that they are not tangential to the user position, but at a divergent angle, which may be more ergonomically suited for some users.

Figure 12:
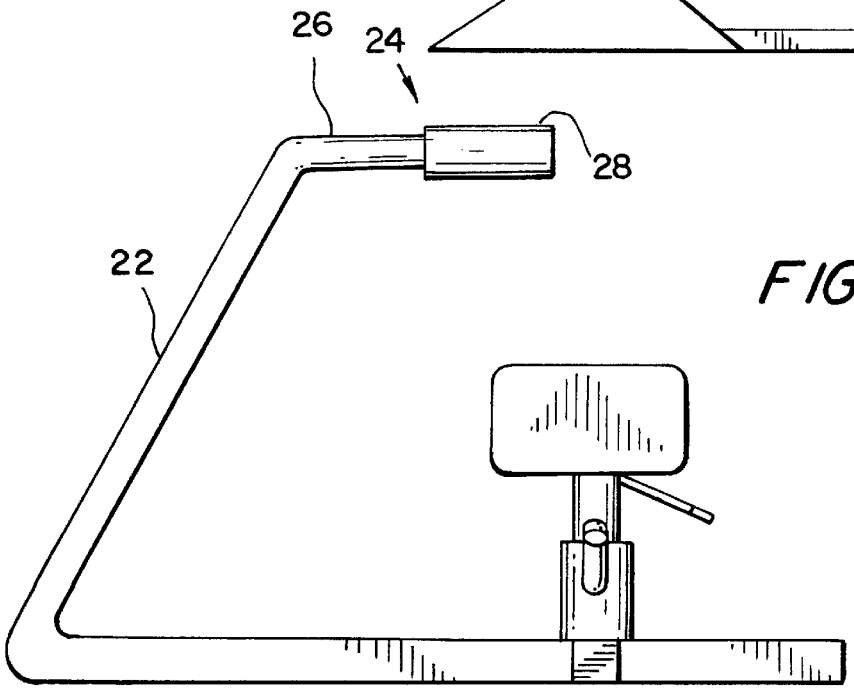
FIG. 12 is a side viewing showing an additional alternative arrangement for the arm member.

FIG. 12 shows yet another alternative arrangement for the arm member 24 in which the arms 26 extend from a support 22 that is upwardly and inwardly bent toward the knee rest, i.e., toward the user position. This configuration may render the exercise apparatus more stable or readily maintainable in close quarters.

Figure 13:
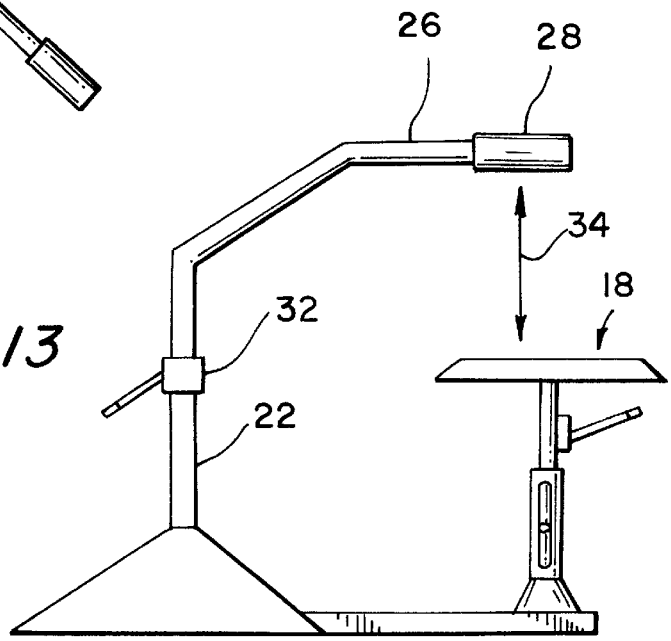
FIG. 13 is a side view showing an alternative configuration for the vertical support of the present invention.

FIG. 13 shows another embodiment of the invention including a vertical support 22 with a height adjustment mechanism 32 for adjusting the length of the vertical support 22. Adjusting the length of the vertical support 22 correspondingly adjusts the distance 34 between the grips 28 of the arms 26 relative to the knee rest 18. This permits a user to adjust the exercise apparatus so that the user may exercise in a safe, comfortable state in which the abdominal muscles are relaxed.

The apparatus operates as follows. A user kneels on the cushioned knee rest 18 and grabs the grips 28. The user then proceeds to twist the lower part of his body back and forth from approximately a 10 o'clock position to approximately a 2 o'clock position (the 12 o'clock position is the one in which the user's hips are parallel to the axis formed by his hands) and back again, keeping the upper part of his body relatively stationary. The workout consists of the repetition of this motion.

The user can optionally add free weights 16 to the arms 14 in order to increase rotational resistance, thereby increasing rotational difficulty. The added weight increases the force necessary to reverse the momentum at the extreme positions of rotation.

The apparatus targets or focuses exertion by certain muscle groups such as the rectus abdominis (upper and lower abdominal muscles) and the externus oblique (also known as love handles). This exertion focus rapidly strengthens and tones these muscles groups to present a fit and trim appearance.

Because a user exercises in a kneeling position, the lower abdominal muscles are being exercised from a relaxed state (as if standing) and not from a contracted state (as if sitting). Because of the torso's limited range of twisting motion, having this advanced kneeling starting point results in using more energy during the work out, and accomplishes the workout with seemingly less effort.

Also, because a user exercises in kneeling position, there is no direct wear and tear taking place in the user's knees. This translates into more comfort for the user as well as decreasing the risk of future knee injuries.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An exercise apparatus comprising:

a base;

a knee rest rotatably mounted on said base;

a first stationary cylinder mounted on said base;

a second cylinder rotatably coupled to the first stationary cylinder, said second cylinder being fixed relative to said knee rest; and a weight arm, mounted on said second cylinder, for receiving a free weight and a first grip, fixed relative to said base, arranged for a user to grasp when kneeling on said knee rest.

2. The exercise apparatus of claim 1, said base comprising a plurality of legs that define a "t" shape.

3. The exercise apparatus of claim 1, wherein said base is planar.

4. An exercise apparatus comprising:

a base;

a knee rest rotatably mounted on said base;

a first stationary cylinder mounted on said base;

a second cylinder rotatably coupled to the first stationary cylinder, said second cylinder being fixed relative to said knee rest; and a resistance system mounted to an outer surface of said second cylinder to restrain the rotation of said second cylinder relative to said first stationary cylinder; and a first grip, fixed relative to said base, arranged for a user to grasp when kneeling on said knee rest.

5. The exercise apparatus of claim 4, further comprising a height adjustment mechanism for adjusting a distance between said knee rest and said base.

6. The exercise apparatus of claim 1, further comprising a second weight arm, fixed relative to said knee rest, for receiving a free weight.

7. The exercise apparatus of claim 1, further comprising a height adjustment mechanism interposed between said knee rest and said base.

8. The exercise apparatus of claim 1, wherein said knee rest has contours for supporting a user.

9. The exercise apparatus of claim 1, wherein said first grip extends tangentially relative to the user.

10. The exercise apparatus of claim 1, further comprising a height adjustment mechanism interposed between said grip and said base.

11. The exercise apparatus of claim 1, further comprising:

a second grip, fixed relative to said base, configured for a user to grasp when kneeling on said knee rest;

a first arm interposed between said first grip and said base; and a second arm interposed between said second grip and said base;

wherein said first arm and said second arm define one of a rounded "U" shape, a squared "U" shape and a "V" shape.

12. The exercise apparatus of claim 1, further comprising a support, interposed between said base and said first arm and said second arm, said support being one of vertical and angled inwardly and upwardly toward the knee rest.

13. The exercise apparatus of claim 1, further comprising:

a second grip, fixed relative to said base, configured for a user to grasp when kneeling on said knee rest;

a first arm interposed between said first grip and said base; and a second arm interposed between said second grip and said base;

wherein said first arm and said second arm extend horizontally linearly, upwardly linearly, curvilinearly and combinations thereof.

14. The exercise apparatus of claim 1, further comprising a support, interposed between said base and said first arm and said second arm, said support being one of vertical and angled inwardly and upwardly toward the knee rest.

* * * * *